US007705256B2

(12) United States Patent
Kenmochi

(10) Patent No.: US 7,705,256 B2
(45) Date of Patent: Apr. 27, 2010

(54) THIN KEY SHEET

(75) Inventor: Yoshio Kenmochi, Tokyo (JP)

(73) Assignee: Sunarrow Limited, Tokyo (JP)

( * ) Notice: Subject to any disclaimer, the term of this patent is extended or adjusted under 35 U.S.C. 154(b) by 158 days.

(21) Appl. No.: 11/815,608

(22) PCT Filed: Feb. 7, 2006

(86) PCT No.: PCT/JP2006/302016

§ 371 (c)(1),
(2), (4) Date: Aug. 6, 2007

(87) PCT Pub. No.: WO2006/082973

PCT Pub. Date: Aug. 10, 2006

(65) Prior Publication Data

US 2008/0277253 A1 Nov. 13, 2008

(30) Foreign Application Priority Data

Feb. 7, 2005 (JP) ..... 2005-029994

(51) Int. Cl.
*H01H 9/00* (2006.01)

(52) U.S. Cl. ..... 200/314; 200/5 A

(58) Field of Classification Search ..... 200/314
See application file for complete search history.

(56) References Cited

U.S. PATENT DOCUMENTS 5,797,482 A * 8/1998 LaPointe et al. ..... 200/314
7,070,349 B2 * 7/2006 Dombrowski et al. ..... 400/490
7,273,993 B1 * 9/2007 Tanner et al. ..... 200/314

FOREIGN PATENT DOCUMENTS

| | | |
|---|---|---|
| JP | 11-134961 | 5/1999 |
| JP | 2002-025374 | 1/2002 |
| JP | 2002-050258 | 2/2002 |
| JP | 2003-007161 | 1/2003 |
| JP | 2004-193060 | 7/2004 |
| WO | WO 2004/038746 A1 | 5/2004 |

OTHER PUBLICATIONS

"Notification of Transmittal of Translation of the International Preliminary Report on Patentability", PCT/JP2006/302016; filed Feb. 7, 2006, 5 pages.

* cited by examiner

*Primary Examiner*—Michael A Friedhofer
*Assistant Examiner*—Lheiren Mae A Anglo
(74) *Attorney, Agent, or Firm*—Westman, Champlin & Kelly, P.A.

(57) ABSTRACT

Mobile phones are in a trend of having thinner configuration due to emphasis on the design. Thus, in order to meet this demand, the present invention aims to thin the key sheet portion as much as possible. The present invention provides a thin key sheet 1 comprising a key top 2 made of a metal or a resin having on the front surface or the back surface indications such as letters, symbols, graphics or the like indicating the functions of keys, a key pad 3 made of a material having rubber elasticity such as a silicone rubber or various elastomers for supporting/fixing the key top, an EL element 8 formed on the back surface of the key top by means of printing, and a printed circuit board 5 on which a switch element is provided at its surface for turning ON/OFF of an electric circuit by the pressing of the key top 2 and on which a circuit pattern involved therewith is formed.

5 Claims, 6 Drawing Sheets

THIN KEY SHEET

CROSS-REFERENCE TO RELATED APPLICATION

The present application is a 35 U.S.C. §371 National Stage Application of, and claims priority of, International patent application Serial No. PCT/JP2006/302016, filed Feb. 7, 2006, now Publication No. WO 2006/082973, published Aug. 10, 2006, and published in Japanese, the content of which is hereby incorporated by reference in its entirety.

TECHNICAL FIELD

The present invention relates to a technology for thinning a key sheet on which a plurality of keys being input means for handy mobile equipments such as portable phones, personal digital assistants (PDA) or the like are assembled and disposed.

BACKGROUND ART

A key sheet is a component constituting a handy mobile equipment such as a portable phone, personal digital assistant (PDA) or the like, and a plurality of key tops which are push buttons each indicating an alphabetical and/or numerical key or a function key are adhered in an arrayed manner to the surface of a single sheet referred to as a key pad. The above-mentioned key pad is a flexible sheet having rubber elasticity such as a silicone rubber, thermoplastic elastomer or the like. On the undersurface of the key sheet thus configured, a printed circuit board provided with a plurality of normally open contacts closed by pressing a push button is closely disposed, so that push button switches are formed, and further a light source for illuminating a key top from the back surface is disposed.

Since the key sheet is thus configured in a state that a plurality of components are piled up in a layered manner, the thicknesses of each one of components are accumulated to have substantial thickness. Therefore, it is requested that the whole handy mobile equipment should be thinned as much as possible so as to further enhance the portability thereof.

However, for example in the method disclosed in Patent Publication 1, there is a structural limit on further thinner configuration because each component to be piled up has a conventional common configuration. Moreover, there is a limit for the thinning of a key sheet only by using an EL sheet thinner than an LED as a light source. That is, while the EL sheet has a thinner thickness compared with an LED (light-emitting diode) which is conventionally used as a light source in a general way, it requires two sheets of resin films as a substrate sheet forming an EL element consisting of the accumulation of an electrode and a light-emitting layer and as a protective sheet. Therefore, despite the fact that thickness of the EL element itself is very thin, there is a limit for thinner configuration (0.2 mm at the lowest under current situation) due to the addition of the thickness of the above-mentioned two resin sheets.

Patent Reference 1: Japanese Laid-Open Patent [Kokai] Publication No. 2002-050258 A

DISCLOSURE OF THE INVENTION

Problems to be Solved by the Invention

Portable phones are in a trend of having thinner configuration due to emphasis on the design. Along with this trend, it is requested that the thickness of a key sheet should be thinned as much as possible. However, as long as the prior art is followed, there is a limit for the thinning of a key sheet. The limit was 1.5 to 1.6 mm.

Although a light source (LED) for illuminating a key top from the back surface is small, it is a three-dimensional structure having a dimension of length, width and height like a small bean, and in particular its height hampers thinner configuration.

When thinning a key top made of resin, 0.6 mm would be a limit in order to gain necessary strength. Further, when using an LED (light-emitting diode) as a light source, it is necessary to provide a key pad with an LED housing part. The housing part needs the thickness of at least 0.6 mm, and it is necessary to secure an operation part with 0.3 mm for ensuring key strokes, so that it is impossible to set the thickness of the key pad to 0.9 mm or less. Further, when using an EL sheet as a light source, the above-mentioned LED housing part would be unnecessary. However, the thickness of the entire key pad including the above-mentioned operation part needs at least about 0.6 mm, to which the thickness of the above-mentioned EL sheet (0.2 mm or more) is added, so that the thickness of the entire key sheet ends up being 1.4 mm or more.

In consideration of such current situation, the objects to be achieved by the present invention are: to reduce the number of the accumulation of each independent component of the key unit part; and to limit the height of a light source, which is one of the causes for hampering thinner configuration, for illuminating a key top from the back surface, in order to thin the thickness thereof as much as possible so as to further enhance the portability of a handy mobile equipment.

Means for Solving the Problems

As one means for achieving the above-mentioned objects, the thickness of a key top is limited to about 0.6 mm when it is made of a resin; or when a key top is what is called a film key with its surface being coated with a resin film, and is made of a metal plate such as stainless steel, the thickness thereof is limited to 0.1 to 0.3 mm. When a key top is made of a metal, openings such as letters or the like are perforated by means of laser etching or chemical etching in order to obtain an illumination type key top.

Further, an attention was paid to a light source for illuminating a key top from the back surface, which hampers thinner configuration. An EL-integrated thin key sheet is configured by using, instead of a conventional three-dimensional light source such as LED or the like, a thin film EL (electroluminescence) element which can reduce the thickness (height) by a large extent, and by forming the thin film EL element on the back surface of a key top by means of printing. Moreover, with regard to the wiring to the thin EL light source, further thinner configuration is tried to be achieved by using a film-forming method for a metal thin film such as deposition, sputtering or the like on a key pad.

Effect of the Invention

While the limit of the thickness of a key unit according to the prior art was 1.5 to 1.6 mm, the limit is broken by carrying out the present invention, enabling thinner configuration down to about 1.0 mm.

Further, by forming an EL element on the back surface of the key top by printing, a base film of the EL element is eliminated, so that the key sheet can be thinned by the eliminated space.

Further, by forming an EL element on the back surface of the key top by printing, a base film of the EL element can become unnecessary, so that the key sheet feel can be enhanced.

BEST MODE FOR CARRYING OUT THE INVENTION

Thinner configuration of a key sheet is tried to be achieved with an embodiment in which a base film of an EL sheet was eliminated by printing an EL element directly on the back surface of the key top and an embodiment in which the wiring to an EL element is formed by means of printing, deposition, sputtering or the like on a key pad which is a flexible sheet having rubber elasticity such as a silicone rubber.

The shapes of mobile phones are roughly classified into a type in which a display part and a key top part are disposed on the same surface and which has a bar shape (straight type) as a whole and into a folding type in which a hinge is disposed between a display part and a key top part so that folding is possible. The key sheet thinning according to the present invention can be applied to either type. Thus, an application example for the folding type (see FIG. 1) is shown as one embodiment.

Figure 2:
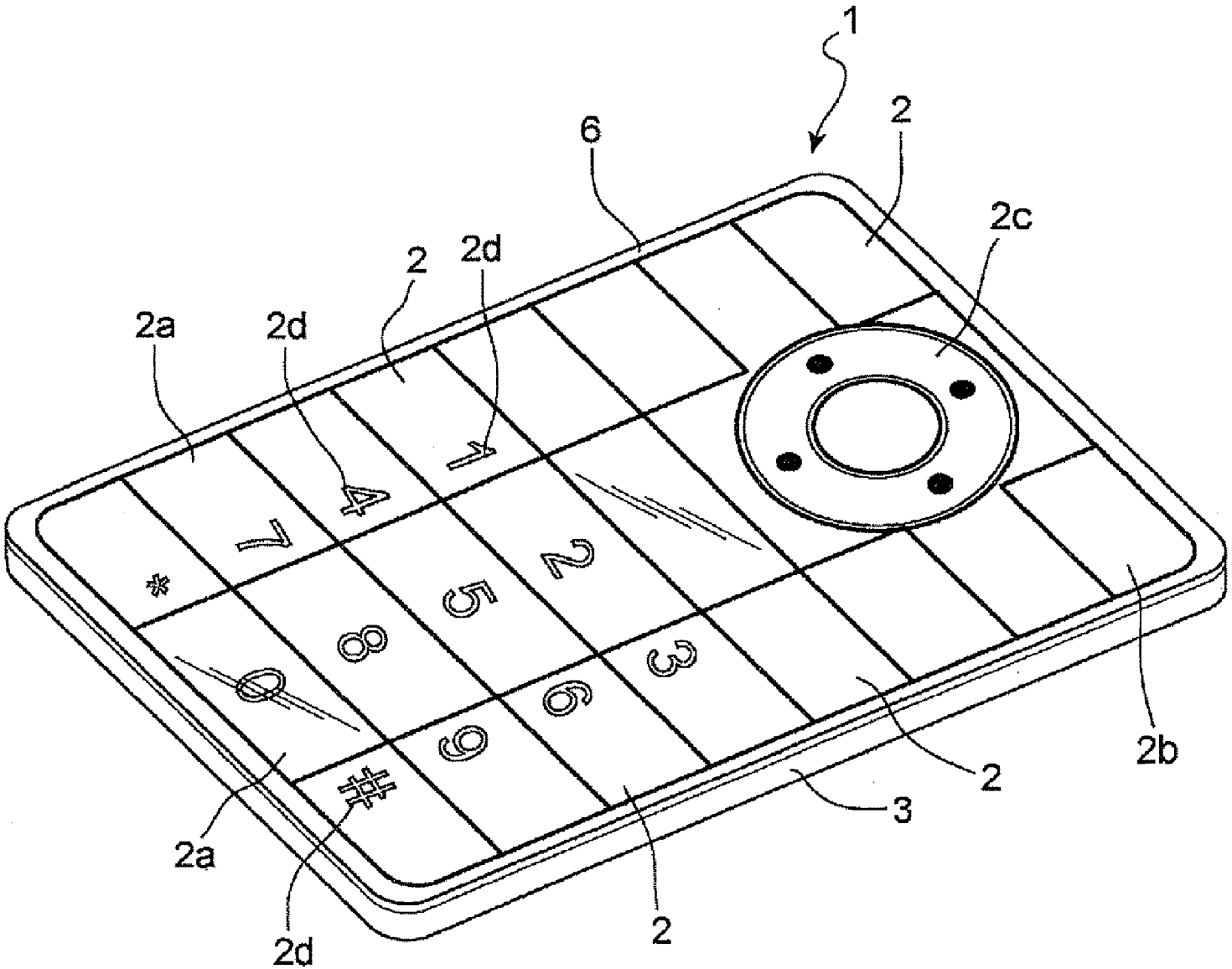
FIG. 2 is a perspective view showing the appearance of Embodiment 1 of a thin key sheet in accordance with the present invention.
Figure 3:
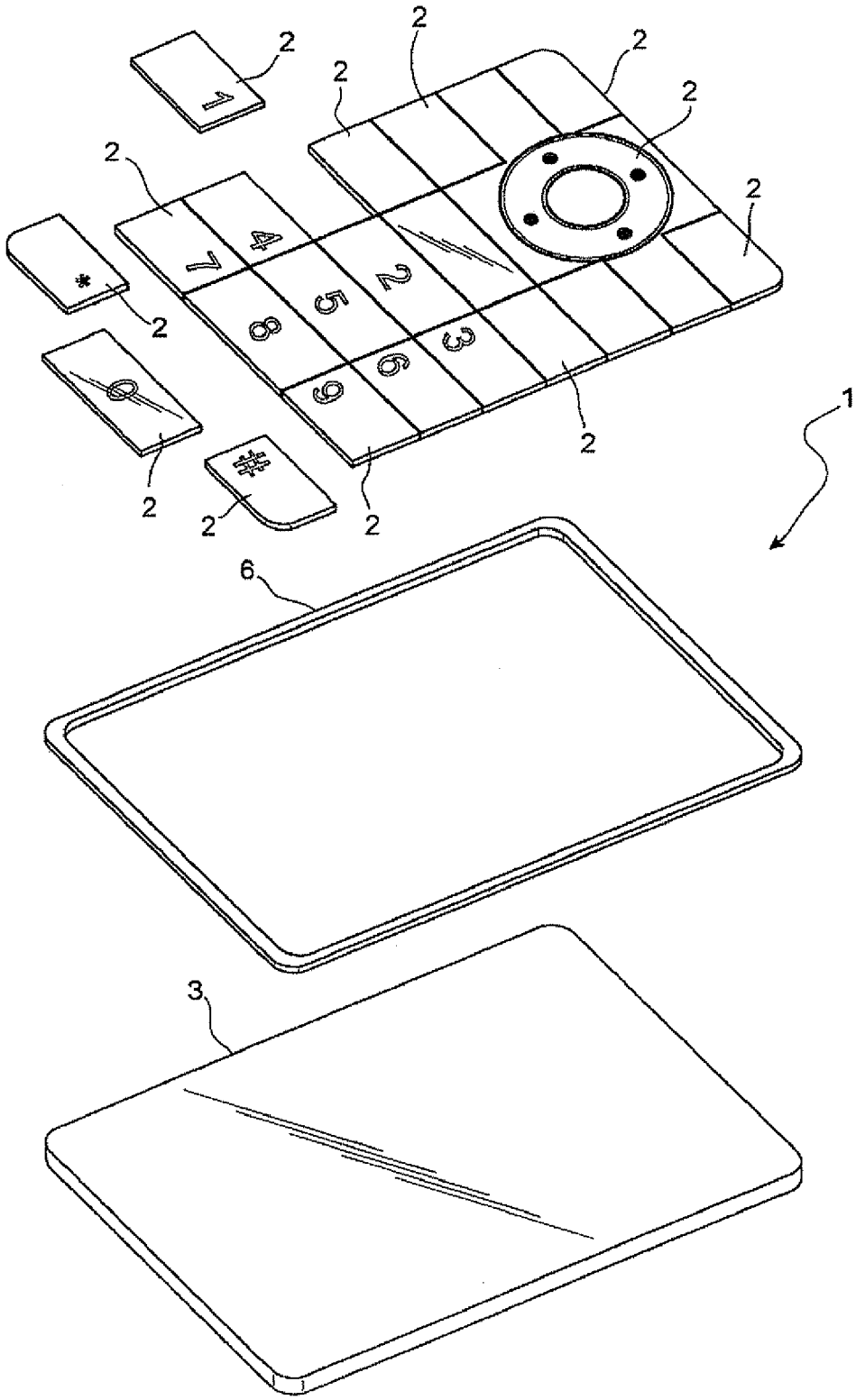
FIG. 3 is an exploded perspective view of Embodiment 1 of a thin key sheet in accordance with the present invention.

As shown in FIGS. 2 and 3, the thin key sheet (hereinafter, referred to simply as "key sheet") 1 comprises: a key top 2, 2, . . . in which a plurality of push button keys such as ten-keys 2*a*, 2*a* on which alphabets, symbols and/or numerals are each indicated, function keys 2*b*, 2*b* to which the functions such as power ON/OFF, the cutting of a line, e-mail or the like are allocated, and a cursor key 2*c* at the upper central part are assembled; key tops 2, 2, . . . corresponding to the above-mentioned each of the keys 2*a*, 2*a*, . . . , 2*b*, 2*b*, . . . , and 2*c*; and a key pad 3 which is a flexible sheet having rubber elasticity for supporting/fixing the key tops 2, 2, . . . such as various thermoplastic elastomers or silicone rubbers. Contact pressing projections (pressing element) 3*a*, 3*a*, . . . protruding downward are each integrally formed on the back surface of the part corresponding to each of the keys 2*a*, 2*a*, . . . , 2*b*, 2*b*, . . . , and 2*c* of the key pad 3. On the undersurface of the key sheet 1 thus configured, a printed circuit board 5 provided with metal domes 4, 4 or the like for electrically connecting, by means of short-circuiting, a plurality of normally open contacts closed by pressing each key top 2 is closely disposed as a switch element. Further, while not an essential configuration, indicated by 6 is a frame for decoration or for supporting the key sheet 1, which is fixed on the key pad 3 and disposed in such a manner as to surround the circumference of each key top 2, 2 . . . .

On the back surface of each key top 2, an EL element 8, 8 . . . which is a light source for illuminating letters, symbols, graphics or the like indicating the functions of each of the keys 2*a*, 2*a*, . . . , 2*b*, 2*b*, . . . , and 2*c* is directly formed by means of an appropriate printing method such as screen printing or the like (see FIGS. 4 to 7). In addition, on the front surface (top surface) and/or on the back surface (undersurface) of the key pad 3, a wiring pattern 3*b* using conductive printing or one metal thin film for electrically connecting the above-mentioned EL element 8, 8, . . . to a printed circuit board 5 is formed by means of a film-forming method for metal thin films such as deposition, sputtering or the like (see FIGS. 4 to 7). Further, when forming a metal thin film on the key pad 3 by means of the above-mentioned film-forming method, it is desirable to conduct film-forming in such a state that a material constituting the key pad 3 is stretched, in order to form the wiring pattern 3*b* securely without breaking. The wiring patterns 3*b* at the front/back side are connected via a through hole 3*c* (see FIGS. 6 and 7). The through hole 3*c* may be filled with conductive rubber or conductive ink 3*d* in order to secure the connection of the wiring patterns 3*b* at the front/back side (see FIG. 6).

Figure 5:
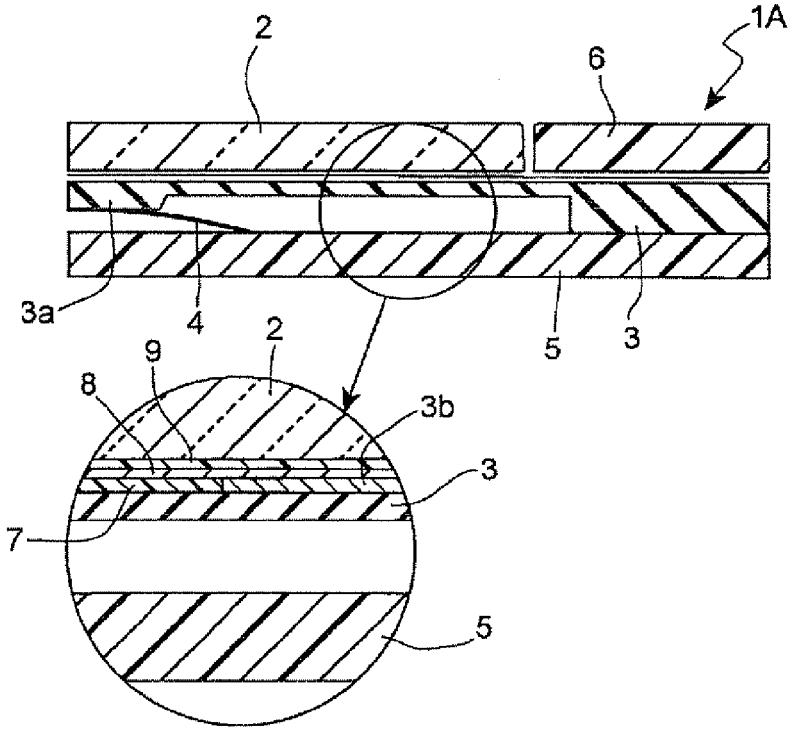
FIG. 5 is an enlarged perspective view showing the structure of Embodiment 2 of a thin key sheet in accordance with the present invention.
Figure 6:
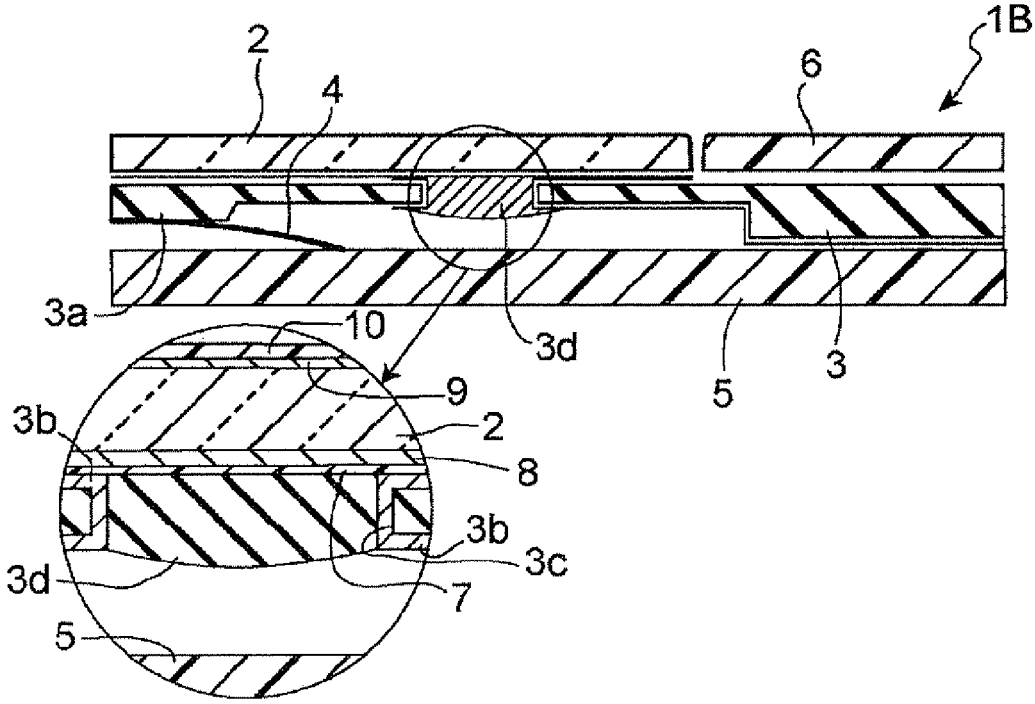
FIG. 6 is an enlarged sectional view showing the structure of Embodiment 3 of a thin key sheet in accordance with the present invention.
Figure 7:
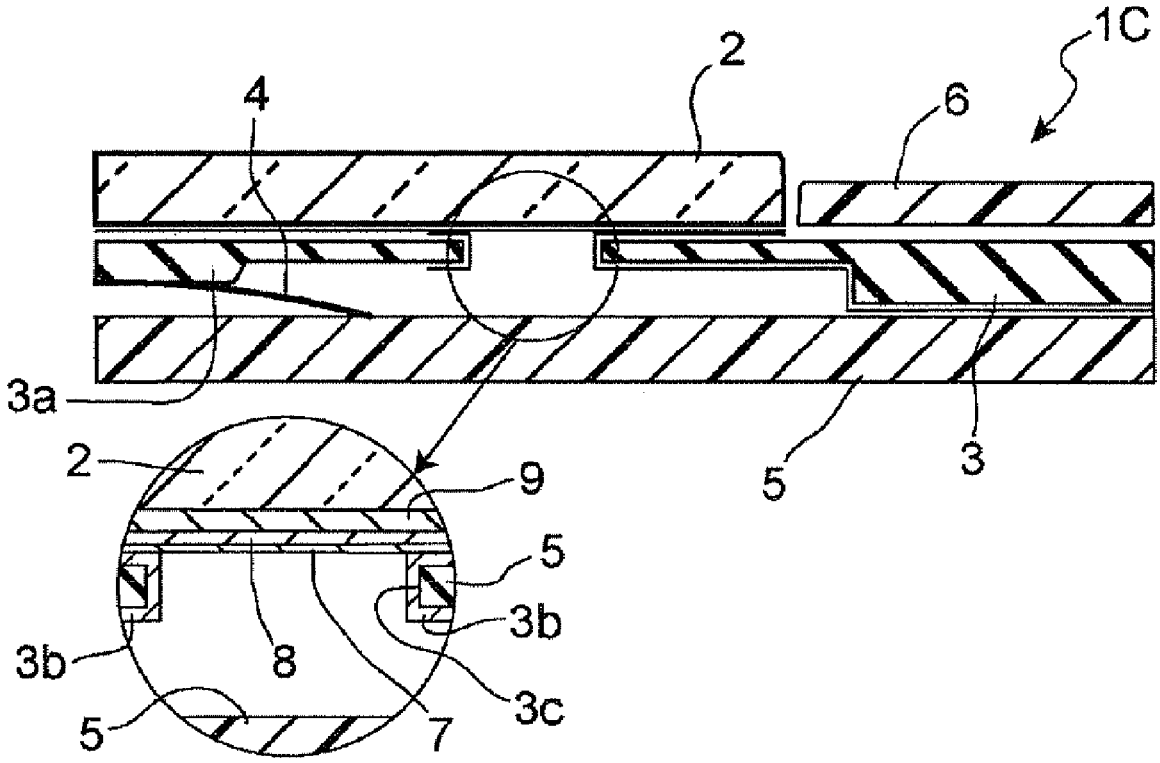
FIG. 7 is an enlarged perspective view showing the structure of Embodiment 4 of a thin key sheet in accordance with the present invention.

Moreover, when each key top 2, 2 . . . is made of a transparent hard resin, there is formed, on the back surface thereof, a letter-printed layer 9 which indicates, in a positive or in a negative form, alphabets, symbols and/or numerals or the like indicative of the functions of each of the keys 2*a*, 2*a*, . . . , 2*b*, 2*b*, . . . , and 2*c* by means of an appropriate method such as screen printing (see FIGS. 5 and 7). The above-mentioned EL element 8 is formed on the letter-printed layer 9. Further, a surface on which the letter-printed layer 9 is formed is not limited to the back surface of the key top 2, but it may also be possible to adopt what is called a film key, i.e., a structure of forming it on the back surface of a film 10 made of an appropriate resin and coating the surfaces (top surface and side surface) of the key top 2 with this film 10 (see FIG. 6), or to adopt a structure of forming it simply on the surface (top surface) of the key top. Specific embodiments of the present invention are given below.

Embodiment 1

Figure 1:
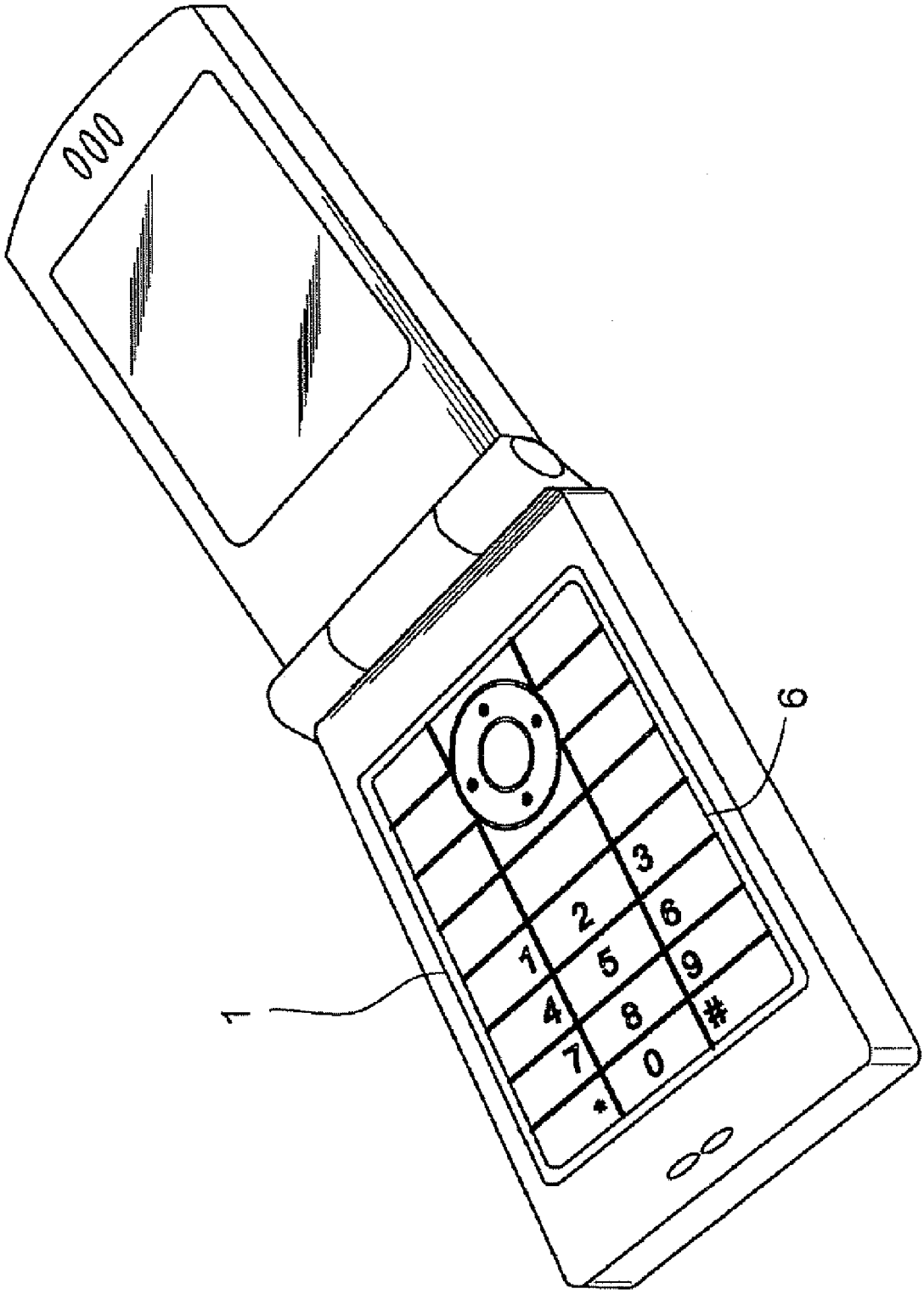
FIG. 1 is a perspective view showing the entire image of a thinned folding portable phone provided with a thin key sheet in accordance with the present invention.
Figure 4:
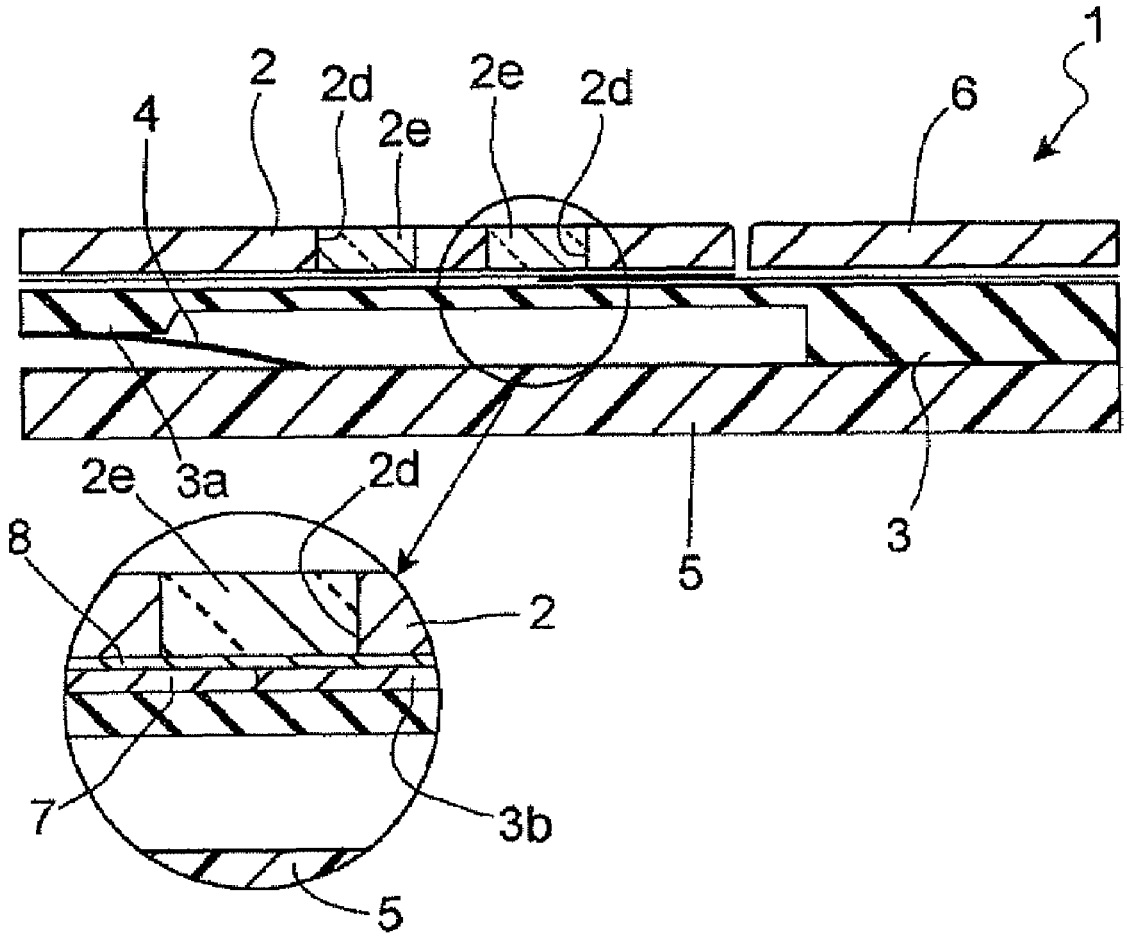
FIG. 4 is an enlarged sectional view showing the structure of Embodiment 1 of a thin key sheet in accordance with the present invention.

FIGS. 1 to 4 show Embodiment 1 of a thin key sheet of the present invention. As shown in FIGS. 1 to 3, a key sheet 1 of the present Embodiment comprises key tops 2, 2, . . . corresponding to various keys 2*a*, 2*a*, 2*b*, 2*b*, and 2*c* and each separately made of a thin metal plate such as stainless steel or the like and a keypad 3 having a top surface on which the key tops 2, 2, . . . are disposed and fixed by means of an adhesive 7 or the like. Underneath the key sheet 1, a printed circuit board 5 formed of a resin is closely disposed. In FIG. 4, when the key top 2 is pressed down, a metal dome 4 short-circuits between two normally open contacts (drawing omitted) disposed on the printed circuit board 5 by being pressed by a pressing element 3*a* on the back surface of the key pad 3. Thereby, an electric circuit is to be completed only during the time when the key top 2 is pressed.

As shown in FIGS. 1 and 4, in order to illuminate alphabets, symbols and/or numerals or the like each indicating the functions of each of the keys 2*a*, 2*a*, 2*b*, 2*b* and 2*c*, the key top 2 is provided with perforated openings 2*d*, 2*d* matched with the shapes of alphabets, symbols and/or numerals or the like by perforating a metal plate constituting the key top 2 from the front surface to the back surface. These perforated openings 2*d*, 2*d* are, as shown in the partial enlarged illustration of FIG. 4, filled with an appropriate transparent resin 2*e*, 2*e* in order to prevent injury of fingers with the opening edge of the perforated openings 2*d*, 2*d*, and for water proof and dust proof.

As a light source for transparent illumination, EL (Electroluminescence) elements 8, 8 are each formed on the back surface of each of the key tops 2, 2 by means of printing or the like. For a wiring for supplying power to each EL element 8, the wiring pattern 3*b* of the key pad 3 made of a silicone rubber or the like is used. The key tops 2, 2, . . . having the above-mentioned configuration are fixed on predetermined locations on the top surface of the key pad 3 by means of the adhesive 7. At the same time, the EL element 8 is electrically connected to the printed circuit board 5 by the wiring pattern 3*b* formed on the key pad.

In the case of the thin key sheet 1 which adopts a key top 2 made of a thin metal plate such as stainless steel or the like shown in the above-mentioned Embodiment 1, it becomes possible to use as a key top 2 a metal plate with a thickness of 0.1 to 0.3 mm, and in addition it becomes possible to set the thickness of the combination of the metal plate and a metal dome 4 with a thickness of 0.2 to 0.3 mm plus the thickness of the key pad 3, i.e., the thickness from the surface of the key top 1 to the surface of the printed circuit board 5 to about 0.88 to 0.98 mm. Moreover, a key top 2 having further thinner configuration would be effective in order to thin the key sheet. However, if it becomes too thin, it end up being deformed and not being restored to its original shape when some stress is applied to the key top 2. Therefore, the thickness of about 0.2 to 0.3 mm is desirable under current situation. However, using a material or a method which solves the problem of the deformation due to stress could enable the thickness of 0.1 mm or less. While omitting illustration and detailed explanation, for example, a structure of sandwiching a metal plate by and between two thin resin films (laminate structure) could enable to further thin the thickness of the metal plate itself without lowering the strength or shape restorability necessary for the key top 2.

Embodiment 2

FIG. 5 shows Embodiment 2 in a sectional view in which a hard resin plate is adopted as the key top 2. As shown in FIGS. 1 and 2, the key sheet 1A in accordance with the present Embodiment 2 comprises ten-keys 2*a*, 2*a* on which alphabets, symbols and/or numerals are each indicated, function keys 2*b*, 2*b* to which the functions such as power ON/OFF, the cutting of a line, e-mail or the like are allocated, and a cursor key 2*c* at the upper central part, a plurality of which keys, being push buttons, are each separately formed as a plurality of key tops 2, 2. The key tops 2, 2 have a structure of operating up and down separately and independently for each of the keys 2*a*, 2*a*, 2*b*, 2*b*, and 2*c*. Each key top 2, 2 is formed of a transparent hard resin such as polycarbonate resin, acrylic hard resin or the like. Along with this, on the back surface of each key top 2, a letter-printed layer 9 in positive or in negative is formed, and an EL element 8 is formed in such a manner as to cover the letter-printed layer 9. Light irradiated from this EL element 8 illuminates various letters or the like indicating the functions of keys formed on the letter-printed layer 9. The key tops 2, 2, . . . are fixed on predetermined locations on the top surface of the key pad 3 by means of the adhesive 7. At the same time, the EL element 8 is electrically connected to the printed circuit board 5 by the wiring pattern 3*b* formed on the key pad.

In the key sheet 1A, when adopting a hard resin plate as the key top 2, the limit of the thickness is 0.6 mm, so that it becomes possible to set the thickness from the surface of the key top 1 to the surface of the printed circuit board 5 to about 1.28 mm. Since the configuration other than those mentioned above of a key sheet 1A basically has the configuration similar to the key sheet 1 of Embodiment 1, descriptions are omitted for the parts with the similar configuration by using the same symbols as those used for the descriptions of the key sheet 1.

Embodiment 3

FIG. 6 shows Embodiment 3 of the thin key sheet of the present invention. The key sheet 1B in accordance with the present Embodiment 3 adopts the structure of what is called a film key for the key top 2. That is, the key top 2, 2 has a structure in which it is covered with the film 10, 10, . . . made of an appropriate transparent resin such as polycarbonate or the like on the surface except the back surface, the top surface and the side surface, and in which the inside thereof is filled with a transparent hard resin. On the back surface of the film 10 (surface adhered to the transparent hard resin at the inside), the letter-printed layer 9 such as alphabets, symbols and/or numerals each indicating the functions of each of the keys 2*a*, 2*a*, 2*b*, 2*b*, and 2*c* for the key top 2, 2 is formed by means of printing or the like. Further, the above key top 2 is formed by means of a general film key production method, i.e., by disposing within a mold a film sheet on which a letter-printed layer 9 or the like was formed beforehand, and injecting a transparent hard resin into the mold to integrally mold the resin and the film sheet. Moreover, in the present Embodiment, the EL element 8 is formed on the back surface of the key top 2, but may be formed on the film 10 above the letter-printed layer 9 by means of printing or the like.

A through hole 3*c* for electrically connecting wiring patterns 3*b*, 3*b* at the front/back sides is formed on the key pad 3. The through hole 3*c* is filled with conductive rubber or conductive ink 3*d*. That is, the through hole 3*c* is filled by printing rubber or conductive ink after the completion of the electrical connection between the top surface and the undersurface. The key tops 2, 2, . . . having the above-mentioned configuration are fixed on predetermined locations on the top surface of the key pad 3 by means of adhesive 7. At the same time, the EL element 8 is electrically connected to the printed circuit board 5 by the wiring pattern 3*b* formed on the key pad.

Each key top 2 of the key sheet 1B can be thinner in its thickness than the key top 2 of the above-mentioned key sheet 1A the whole of which is formed by a hard resin due to the enhanced strength by the film 10 for coating the surface, thus allowing the thickness of 0.3 mm. Therefore, the entire thickness thereof fell within about 0.98 mm. Since the configuration other than those mentioned above of a key sheet 1B basically has the configuration similar to the key sheet 1A of embodiment 2, descriptions are omitted for the parts with the similar configuration by using the same symbols as those used for the descriptions of the key sheet 1.

Embodiment 4

FIG. 7 shows Embodiment 4 of the thin key sheet in which a hard resin plate is adopted as the key top 2. The key sheet 1C in accordance with the present Embodiment 4 has appropriately the same basic configuration as the key sheet 1A in Embodiment 2, and comprises ten-keys 2*a*, 2*a* on which alphabets, symbols and/or numerals are indicated, function keys 2*b*, 2*b* to which the functions such as power ON/OFF, the cutting of a line, e-mail or the like are allocated, and a cursor key 2*c* at the upper central part, a plurality of which keys, being push buttons, are each separately formed as a plurality of key tops 2, 2. Each key top 2, 2 is formed of a transparent hard resin such as polycarbonate resin, acrylic hard resin or the like. Along with this, on the back surface of each key top 2, a letter-printed layer 9 in positive or in negative is formed, and an EL element 8 is formed in such a manner as to cover the letter-printed layer 9. Light irradiated from this EL element 8 illuminates various letters or the like indicating the functions of keys formed on the letter-printed layer 9.

A through hole 3*c* for electrically connecting wiring patterns 3*b*, 3*b* at the front/back sides is formed on the key pad 3. The key tops 2, 2, . . . having the above-mentioned configuration are fixed on predetermined locations on the top surface of the key pad 3 by means of the adhesive 7. At the same time, the EL element 8 is electrically connected to the printed circuit board 5 by the wiring pattern 3*b* formed on the key pad.

The appearances of the key sheet 1C of the Embodiment 4 are approximately the same as the key sheet 1A shown in FIG. 5. Since the configuration other than those mentioned above of the key sheet 1C basically has the configuration similar to the key sheets 1 and 1A or the like, descriptions are omitted for the parts with the similar configuration by using the same symbols as those used for the descriptions of the key sheet 1. Further, the letter-printed layer 2 does not always need to be formed on the back surface thereof, but an appropriate decoration may be applied for forming a hue of the appearance, letters or the like on its surface (the top surface and the side surface exposed to the outside) by means of painting or the like.

A metal dome 4 is interposed between the pressing element 3*a*, 3*a*, . . . on the undersurface of the key pad 3 and the printed circuit board 5. The metal dome 4 is made of a material having conductivity and shape memory capacity such as phosphor bronze, and its name is derived from its dome-like shape. The metal dome 4 does not always need to have such dome-like shape. It is sufficient for the metal dome 4 to have a shape and a structure in which: when the key top 2 is pressed down, normally open contacts are closed for certain by being pressed by the pressing element 3*a* of the key pad 3; and when the key top 2 is not pressed down, the metal dome 4 can be restored to its original shape. When a specific key top 2 is pressed down, the metal dome 4 functions to close, in response to the press-down movement of the metal dome element, normally open contacts printed-wired on the printed circuit board 5 disposed therebelow so as to form an electric circuit.

The letter-printed layer 9 which corresponds to decorations including letters, symbols or the like which indicate the function of each key is applied to the top surface or the undersurface of the key top 2 by means of various arbitrary decoration methods. Even when the key top is made of a metal, if not giving a metal-like appearance to the key sheet, various types of paintings can also be applied to its surface.

INDUSTRIAL APPLICABILITY

Since the present invention relates to a thin key sheet for use in mobile equipment such as portable phones, and personal digital assistants (PDA), it has a wide range of applicability in industrial fields seeking thinner configuration of these equipment provided with keys, including manufacturing industries of electronic equipment and the various components thereof.

The invention claimed is:

1. A thin key sheet comprising a key top made of a metal or a resin having on the front surface or the back surface indications such as letters, symbols, graphics or the like indicating the functions of keys, a key pad made of a material having rubber elasticity such as a silicone rubber or various elastomers for supporting/fixing the key tops, and an EL element for illuminating the key top, wherein the EL element is formed on the back surface of the key top by means of printing, and a wiring to the EL element is formed at least on the top surface of the key pad of a silicone rubber by means of any one of printing, deposition, and sputtering, and the EL element is electrically connected to the wiring by fixing the back surface of the key top onto the top surface of the key pad.

2. The thin key sheet according to claim 1, wherein, when the wiring to the EL element is provided not only on the top surface but also on the back surface of the key pad, the front surface and the back surface thereof are connected via a through hole, and the through hole after the connection is filled by means of conductive printing or rubber filling.

3. The thin key sheet according to claim 1, wherein, when the key top is made of a metal, perforated openings in the shape of letters or symbols are perforated on the key top by means of laser etching or chemical etching in order to obtain an illumination type key top.

4. The thin key sheet according to claim 1, further comprising a printed circuit board on which a switch element is provided at its surface for turning ON/OFF of an electric circuit by the pressing of the key top and on which a circuit pattern involved therewith is formed.

5. The thin key sheet according to claim 1, wherein when the wiring to the EL element is formed by means of a film-forming method for metal thin films such as deposition, sputtering or the like, the film-forming is conducted in such a state that a material having rubber elasticity is stretched.

* * * * *